United States Patent [19]

Breidenbach et al.

[11] 4,414,072

[45] Nov. 8, 1983

[54] DOOR FOR COKING CHAMBER OF COKE-OVEN BATTERY

[75] Inventors: Dieter Breidenbach, Waltrop; Wilhelm Mosebach, Kamen-Mettheler, both of Fed. Rep. of Germany

[73] Assignee: WSW Stahl-und Wasserbau GmbH, Waltrop, Fed. Rep. of Germany

[21] Appl. No.: 332,317

[22] Filed: Dec. 18, 1981

Related U.S. Application Data

[60] Continuation-in-part of Ser. No. 303,609, Sep. 18, 1981, which is a division of Ser. No. 182,004, Aug. 27, 1980, abandoned.

[30] Foreign Application Priority Data

Nov. 8, 1979 [DE] Fed. Rep. of Germany ..... 2945017
Jan. 4, 1980 [DE] Fed. Rep. of Germany ..... 3000161

[51] Int. Cl.[3] ..... C10B 25/06; C10B 29/04
[52] U.S. Cl. ..... 202/248; 202/268
[58] Field of Search ..... 202/248, 268; 110/173 R; 49/483, 485; 201/14, 41

[56] References Cited

U.S. PATENT DOCUMENTS 2,308,999 1/1943 Moore ..... 202/248
2,855,347 10/1958 Cellan-Jones ..... 202/248
2,993,845 7/1961 Coe ..... 202/248
4,086,145 4/1978 Muller ..... 202/248
4,118,284 10/1978 Bowman et al. ..... 202/248
4,197,163 4/1980 Aikman ..... 202/248
4,217,177 8/1980 Gerding et al. ..... 202/248

FOREIGN PATENT DOCUMENTS 1087455 2/1955 France ..... 202/248
1102059 10/1955 France ..... 202/248

*Primary Examiner*—Bradley Garris
*Attorney, Agent, or Firm*—Joseph J. O'Keefe; Karl F. Ross

[57] ABSTRACT

A coking chamber of a coke-oven battery, with heated longitudinal walls interconnected by a doorjamb at each end, is closed by a pair of doors sealingly fitting into these doorjambs. Each door has a vertical channel separated from the exterior by an outer wall with a heat-insulating layer and from the interior of the chamber by an upright metal plate facilitating thermal conduction therebetween. The channel is accessible at various levels or over its entire length to gases evolving from a charge inside the chamber which, in rising toward the roof of the chamber, retransmit some of their heat through the metal plate to the charge for enabling substantially uniform heating thereof from four sides.

6 Claims, 5 Drawing Figures

DOOR FOR COKING CHAMBER OF COKE-OVEN BATTERY

CROSS-REFERENCE TO RELATED APPLICATIONS

This is a continuation-in-part of our copending application Ser. No. 303,609 filed Sept. 18, 1981 as a division of application Ser. No. 182,004 filed Aug. 27, 1980 and now abandoned.

FIELD OF THE INVENTION

Our present invention relates to a door for a coking chamber of a coke-oven battery as well as to a coking chamber provided with a pair of such doors.

BACKGROUND OF THE INVENTION

A coke plant normally has a battery of coking chambers of rectangular horizontal outline that are separated from one another by heated walls defining their longer sides and are open at their two narrower ends. These ends are provided with doorjambs against which respective coke-oven doors can sealingly fit during the coking process to hold the charge in the respective chamber and to prevent the escape of gases and heat from the chamber. These doors, as described on pages 120 ff. of *The Making, Shaping and Treating of Steel* by H. McGannon (Herbick & Hood: 1971), each have a rigid panel with a periphery complementary to the respective doorjamb. A seal is provided at this periphery for forming a gastight connection between the periphery and the doorjamb, and holding means serve to press the door tightly onto the respective doorjamb. Mounted on the inner face of this panel is a vertically elongated and horizontally projecting plug of refractory insulating material that extends into the respective coking chamber. The insulating plug protects the door from overheating while similarly preventing the ends of the charge inside the chamber from being inadequately coked because of excessive cooling. Gases generated during the coking process normally are drawn off from the space formed between the upper level of the charge and the roof of the chamber.

The plugs normally project some 400 mm from the iron door frames into the chambers and are generally formed from interfitting refractory bricks which are very heavy and relatively expensive to mount in place and maintain. Normally the chambers also have a refractory lining that projects outward roughly to the level of the refractory lining of the door, leaving a gap. As this gap fills with particulate material during use, it must be meticulously cleaned after each coking process.

In order to reduce the gas pressure acting upon the door during a coking process, there has been proposed in accordance with U.S. Pat. No. 4,086,145 to Joseph M. Muller a coke-oven door provided with a generally flat metallic barrier spaced inward from its frame. The barrier, which is covered by a thermally insulating protective layer, holds the charge separated from the door frame while facilitating the rise of evolving gases. After escaping into the collection manifold, these gases must be quenched so that their heat content is uselessly dissipated.

OBJECTS OF THE INVENTION

An important object of our present invention is to provide an improved coke-oven door which, besides realizing the advantages of the structure disclosed in U.S. Pat. No. 4,086,145, enables the utilization of the heat of the gases evolving from a charge in the associated coking chamber.

A related object is to provide a door construction for such a chamber which enables substantially uniform heating of the charge from all sides during the coking process.

SUMMARY OF THE INVENTION

A door embodying our invention comprises an upright metal plate spaced inwardly from a frame sealingly engaging a doorjamb of a coking chamber so as to define therewith a vertical channel extending substantially over the full height of that chamber. In contrast to the teaching of the Muller patent, where the disclosed insulation serves only to protect the door lining, the frame itself carries a thermally insulating layer designed to prevent the loss of heat to the exterior and to protect the door body, this layer extending therefore over substantially the full width and height of the frame. The channel communicates with the interior of the chamber whereby gases evolving from the charge during the coking process can enter the channel along its height and pass upward to a flue in the roof of the chamber. In the course of this upward movement, the gases retransfer a considerable part of their heat through the relatively thin metal plate to the charge at the normally unheated narrow sides of the coking chamber. When that chamber is closed by a pair of such doors at both the pusher side and the coke side, the charge is heated from all four sides.

We have found that the heat transfer from the gases to the charge can be significantly enhanced by plate-supporting stays, with central webs, which are vertically spaced apart and create a certain amount of turbulence in the rising gas flow.

BRIEF DESCRIPTION OF THE DRAWING

The above and other features of our invention will now be described in detail with reference to the accompanying drawing in which.

SPECIFIC DESCRIPTION

Figure 1:
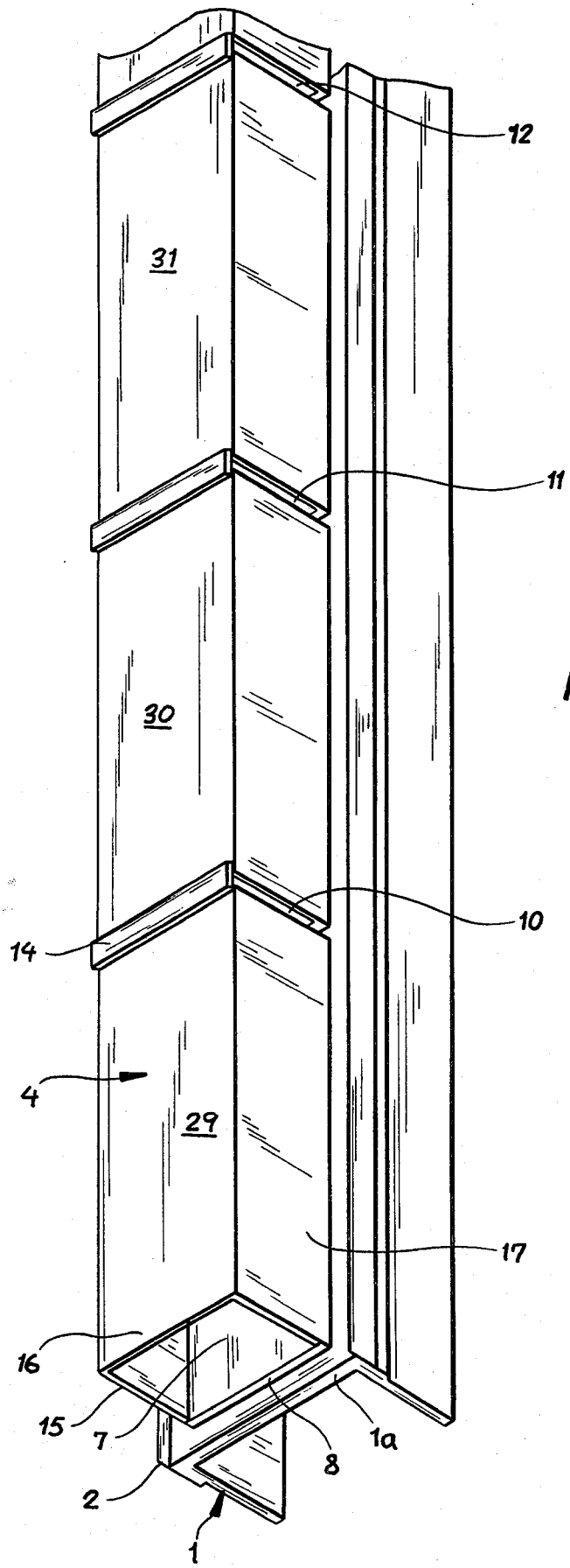
FIG. 1 is a perspective view of a lower part of a coke-oven door embodying our invention.
Figure 2:
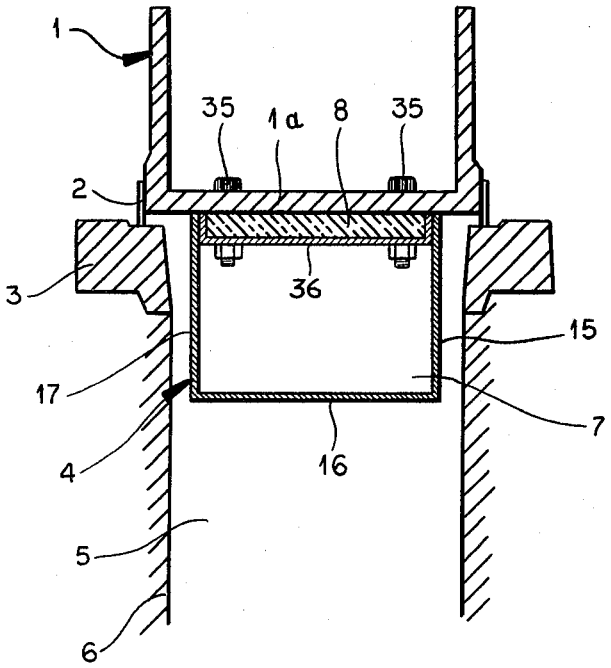
FIG. 2 is a cross-sectional top view of part of a coking chamber provided with the door of FIG. 1.
Figure 3:
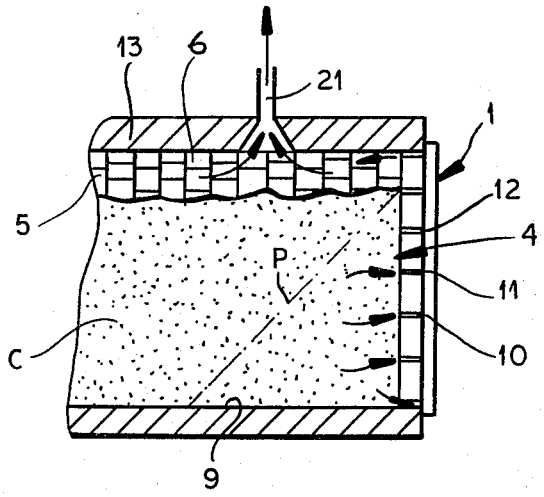
FIG. 3 is a fragmentary cross-sectional side view of the assembly of FIG. 2, drawn to a smaller scale.
Figure 5:
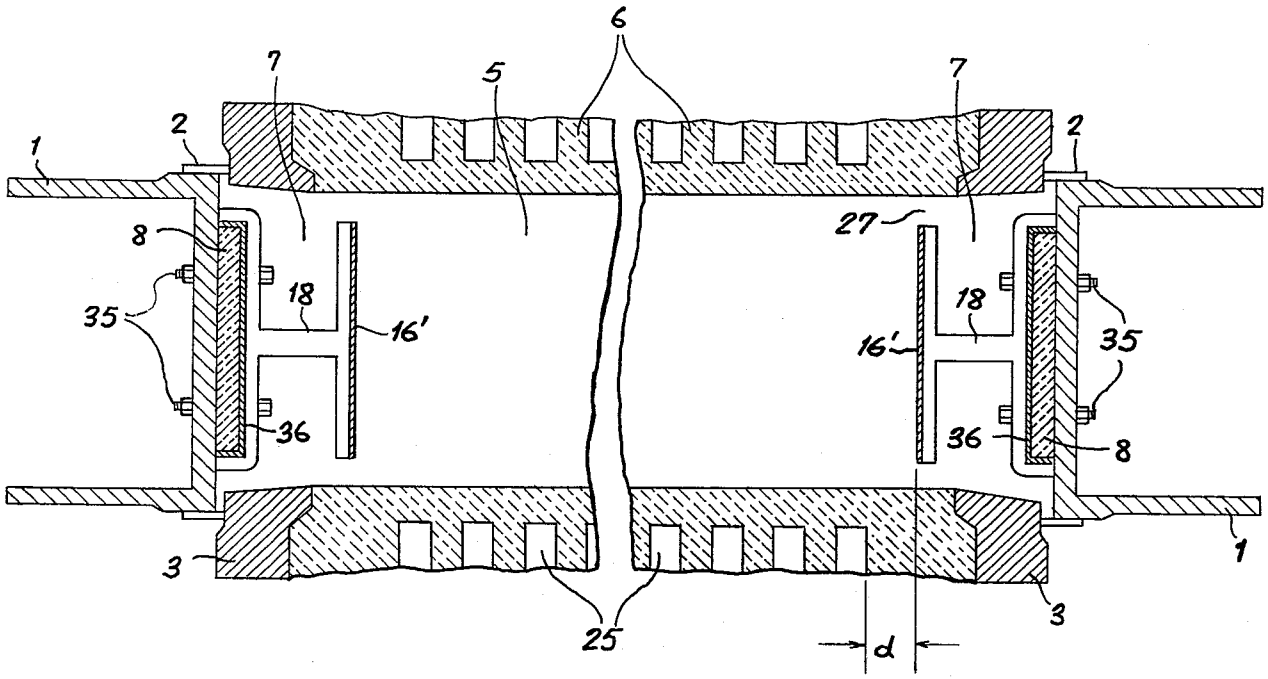
FIG. 5 is a somewhat diagrammatic view of a coking chamber provided with two doors of the type shown in FIG. 4.

As shown in FIGS. 1–3, a coke-oven door according to our invention has a rigid metallic frame 1 provided around its periphery with a seal 2 engageable with a doorjamb 3 of a coking chamber 5. A throughgoing heat-insulating layer 8, preferably consisting of a mat of refractory fibers surrounded on at least three sides by vertically separated sections 36 of a sheet-metal shell, extends over the major part of a wall member 1*a* of frame 1 to which these sections are secured by bolts 35 in a manner facilitating their thermal expansion. A metallic body 4 of prismatic shape, with sidewalls 15, 17 and an inner or front wall 16, complements the insulating layer 8 to an upright duct enclosing a vertical channel 7. Body 4 is vertically divided into a multiplicity of sections 29, 30, 31 . . . separated by horizontal gaps 10, 11, 12 . . . enabling hot gases from the interior of chamber 5 to enter the channel 7 and to rise alongside a charge C of coal toward a flue 21 provided in the chamber roof 13. The major sides of the coking chamber are bounded by walls 6 which are provided in the usual manner with vertical heating flues 25 as shown in FIG. 5.

The several metallic duct sections 29 etc., which may have a wall thickness of less than 1 cm (e.g. 8 mm) compared with a thickness of about 5 to 7 cm for the heat-insulating layer 8, are fastened to frame 1 by nonillustrated bolts in a manner facilitating their thermal expansion. Gaps 10 etc. are overlain at the inner plate 16 by cover strips 14 each secured to an adjoining section. The chamber may have a height of 7 meters and an effective width of 45 cm, for example.

Evolving gases entering the channel 7 at its bottom and through its lateral slots 10, 11, 12 . . . rise within the channel and heat the charge C through the plate 16.

Figure 4:
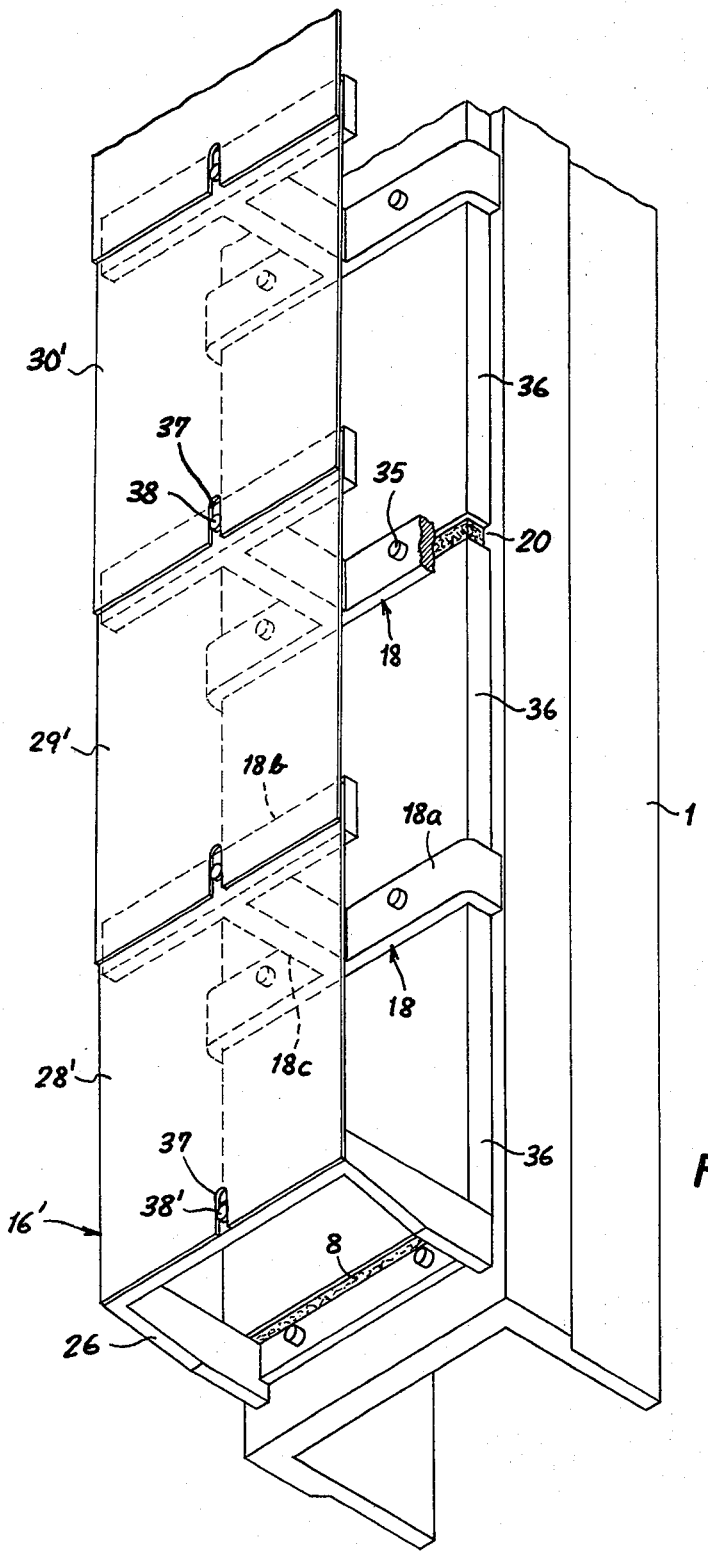
FIG. 4 is a view similar to that of FIG. 1, illustrating a modified door construction according to our invention.

In FIG. 4 we have shown a modified door whose frame 1 and insulating layer 8 with enveloping shell sections 36 are generally similar to those of the door of FIGS. 1–3 but wherein sidewalls 15 and 17 have been omitted so that its channel 7 is laterally open. A front plate 16', consisting of overlapping sections 28', 29', 30' . . . , is supported on frame 1 with the aid of individual stays 18 and end brackets 26 (only one shown). Channel 7 is laterally accessible for the full height of the front plate 16' through narrow vertical gaps 27 left between plate 16' and chamber walls 6 as seen in FIG. 5.

Each stay 18 has a pair of flanges **18*a*, 18*b* interconnected by a central web 18*c* which creates turbulence in the gas flow rising within the channel, thereby intensifying the heat transfer through plate 16'. The generally C-shaped flanges 18*a* overlie the gaps 20 between adjoining shell sections 36, which terminate at the levels of overlap of plate sections 28' etc., and are engaged by the bolts 35 traversing the gaps 20 whereby the shell sections are held somewhat loosely in position around the through-going layer 8 with freedom of expansion under heat. Each plate section, fixedly secured to a stay (or to the upper end bracket) along its top edge, is similarly expandable; their lower edges have guide slots 37 receiving the ends of bolts 38, which serve to fasten the overlapped plate sections to their stays, or—in the case of the lowest plate section—by a bolt 38' engaging only the end bracket 26**.

The two coke-oven doors illustrated in FIG. 5 at opposite ends of coking chamber 5 are substantially identical, except that the pusher-side door (e.g. the one at left) may be provided near the top of its frame 1 with an opening for a leveling bar as shown for example in the above-identified Muller patent. In the present instance, however, the channel 7 must not be blocked by a box or a horizontal shelf lying just below the opening, as in the patent referred to, in order not to obstruct the upward gas flow.

From FIG. 5 it will further be noted that the first heat flue 25 at each end of each chamber wall 6 is spaced inward from the heat-conducting plate 16' of the respective door by a distance d which in practice may be at least 200 mm with a chamber whose length ranges between 10 and 15 meters, for example. This is possible because, as we have found, gases with an initial temperature of about 600°–900° C. will pass sufficient heat through a metal plate 16 or 16' of less than 1 cm thickness to cure the charge in this chamber to a depth of about 20 cm so that the spacing of that plate from its frame can be correspondingly foreshortened whereby the useful chamber length is increased by, say, 40 cm. It may generally be assumed that gases will reach the channel 7 from an adjacent part of the charge bounded by a plane P, FIG. 3, which slopes down at a 45° angle from the line of contact between the plate 16 or 16' and the top level of the charge.

If desired, the plate sections may be corrugated or ribbed for a further intensification of heat transfer by an increase in their effective surface area.

On account of the high gas temperatures prevailing in channel 7, little if any condensation occurs in the region of the seal 2 so that the cleaning of the frame and of the doorjamb after removal of the door itself is considerably simplified.

We claim:

1. A door for a coking chamber of a coke oven battery provided with a doorjamb at the narrow ends of the chamber between two major parallel chamber walls comprising:

a door frame sealingly engaging said doorjamb;

support means having an outer end thereof mounted on said doorframe and having an inner end thereof extending into an associated coking chamber fitted with said door;

a thermally conductive metal plate arranged and constructed to:

be mounted on said support means at the inner end thereof, be spaced from said door frame to define therewith a vertical channel, provide access to said channel by heated gases entering said channel from a charge of coal in said coking chamber, permit said heated gases entering said channel to flow upwardly therein and transfer a considerable part of the heat of said gases through said metal plate to the coal charge in said chamber at the normally unheated end thereof adjacent said metal plate; and a heat insulating layer on said frame extending over substantially the full width and height thereof for minimizing the escape of heat from said gases to the exterior of said frame.

2. A door as defined in claim 1 wherein said support means comprises a plurality of vertically spaced mounting members supporting mutually overlapping sections of said metal plate.

3. A door as defined in claim 2 wherein said mounting members are stays with central webs and with flanges secured to said door frame.

4. A door as defined in claim 1, 2 or 3 wherein said metal plate has a thickness of less than 1 centimeter.

5. In a coking chamber generally bounded by heated longitudinal walls and by a pair of removable doors received in doorjambs spanning said longitudinal walls at the narrow ends of said chamber, the improvement wherein each of said doors comprises:

a door frame sealingly engaging a respective doorjamb;

a heat insulating layer on said doorframe extending over substantially the full width and height thereof;

support means having the outer end thereof mounted on said doorframe and the inner end thereof extended into said chamber;

a thermally conductive metal plate arranged and constructed to:

be mounted on said support means at the inner end thereof, be spaced from said doorframe to define therewith a vertical channel, have lateral edges thereof separated by narrow gaps from said longitudinal walls, provide access to said channel by heated gases entering said channel through said narrow gaps from a charge of coal in said coking chamber, and permit said heated gases entering said channel to flow upwardly therein and transfer a considerable part of the heat of said gases through said thermally conductive metal plate to the coal charge in said chamber at the normally unheated narrow end thereof adjacent said metal plate;

whereby the charge of coal in said chamber is heated substantially uniformly from said longitudinal walls and said thermally conductive metal plate of each said door and the escape to the exterior of each said doorframe of heat from said gases rising in each said channel is minimized.

6. A door for a coking chamber of a coke oven battery provided with a doorjamb at the ends of two major chamber walls comprising;

a doorframe sealingly engaging said doorjamb;

a plurality of vertically spaced support means, each having an outer end thereof mounted on said doorframe and an inner end thereof extended into an associated coking chamber fitted with such door;

a plurality of thermally conductive metal plates, each arranged and constructed to:

be mounted on at least one of said vertically spaced support means at the inner end thereof, be spaced from said doorframe to define therewith a vertical channel, have the lateral edges thereof spaced, for the height of said plate, by narrow gaps from said walls, provide access to said channel by heated gases entering said channel through said narrow gaps from a charge of coal in said coking chamber, and permit said heated gases entering said channel through said gaps to flow upwardly in said channel and transfer a considerable part of the heat of said gases through said thermally conductive metal plate to the coal charge in said chamber at the normally unheated end of said coal charge adjacent said plate;

a heat insulating layer on said doorframe for minimizing the escape of heat from said heated gases to the exterior of said doorframe.

* * * * *